United States Patent [19]

Akiba et al.

[11] Patent Number: 4,800,285

[45] Date of Patent: Jan. 24, 1989

[54] FLAME DETECTING ARRANGEMENT FOR DETECTING A FLAME THROUGH HORIZONTAL AND VERTICAL SCANNING OF A SUPERVISORY REGION BY USING A PHOTODETECTOR

[75] Inventors: Kouji Akiba, Yokohama, Japan; Akira Kitajima, Huntington Berch, Calif.; Yoshio Arai, Sagamihara, Japan

[73] Assignee: Hochiki Kabushiki Kaisha, Tokyo, Japan

[21] Appl. No.: 68,145

[22] Filed: Jun. 29, 1987

[30] Foreign Application Priority Data

Jun. 30, 1986 [JP] Japan ..... 61-153225

[51] Int. Cl.[4] ..... G08B 17/12

[52] U.S. Cl. ..... 250/554; 340/578

[58] Field of Search ..... 250/554, 340, 342; 340/578, 587

[56] References Cited

U.S. PATENT DOCUMENTS 4,671,362 6/1987 Odashima ..... 340/578

4,706,760 11/1987 Arai et al. ..... 340/578

*Primary Examiner*—David C. Nelms
*Assistant Examiner*—Stephone B. Allen
*Attorney, Agent, or Firm*—Max Fogiel

[57] ABSTRACT

A flame detecting apparatus and a flame detecting method which utilizes a flame detector having a directivity and provided with a photodetector such as a photodiode or a phototransistor which produces a photo-output in response to the intensity of light incident thereupon. The flame detector is scanned sequentially in the horizontal and the vertical direction within a supervisory region. When a photo-output from said flame detector obtained in the horizontal or vertical scanning by said scanning means exceeds a predetermined threshold value, one of the horizontal and the vertical scanning is suspended, while repeating the other, vertical or horizontal, scanning at the same horizontal or vertical position several times. Flame determination is made when the changes in the photo-outputs, which is obtained through the repeated scanning, exceed a predetermined value and they last over a predetermined scanning angle.

8 Claims, 6 Drawing Sheets

FLAME DETECTING ARRANGEMENT FOR DETECTING A FLAME THROUGH HORIZONTAL AND VERTICAL SCANNING OF A SUPERVISORY REGION BY USING A PHOTODETECTOR

BACKGROUND OF THE INVENTION

1. Field of the Invention

This invention relates to a flame detecting apparatus and a flame detecting method for detecting a flame through horizontal and vertical scanning for a supervisory region by using a photodetector such as a photodiode or a phototransistor.

2. Prior Art

In a conventional flame detecting apparatus for detecting a flame by allowing a directional flame detector to scan horizontally and vertically within a supervisory region, a pyroelectric element is used as a detecting element of the flame detecting apparatus. The pyroelectric element is generally known as a differential-type detecting element which generates a photo-output only when light energy changes. However, the pyroelectric element is poor in response characteristic to a flame and takes a long time to detect the flame. In addition, the pyroelectric element is expensive, too. By this reason, it may be proposed to use a photodiode or phototransistor which is not expensive and good in response characteristic.

However, the photodiode or phototransistor is not a differential element but a photoelectric transducer element as widely known, which produces an output corresponding to the intensity of light incident thereupon. Therefore, it can not be determined whether there is detected a flame or not, only from a photo-output. A flame can be determined only when a photo-output exceeding a predetermined threshold value, preset for the flame detection determination, is obtained, to produce an alarming output. By this reason, when the photodiode or phototransistor is used as the detecting element of the flame detector, it is liable to be affected by stationary light as ambient phenomena, such as sunlight or light from an incandescent lamp. More particularly, in the case of pyroelectric element, the detecting wave range extends over near infrared range to long wave range, so that the incident light may be passed through a filter so as to detect light which is not present as the stationary light but included in a flame of a fire, for example, to detect emission spectrum of carbon dioxide. On the other hand, since the photodiode or phototransistor has a narrow detecting wave range and it has a best sensitivity in the near infrared range, the detecting range is not set in a non-stationary area even if the incident light is passed through the filter. By this reason, if the sun behind the clouds abruptly appears and shines, or if the sunlight reflected from a mirror in a room is suddenly incident upon the flame detector, the pyroelectric element causes no output. In contrast, the photodiode or phototransistor easily produces a photo-output exceeding the threshold value to give a false alarm.

EPC No. 0098,235 was known as a relative patent in the development of this invention.

SUMMARY OF THE INVENTION

Object of the Invention

The present invention has been made to obviate these problems, and it is an object of the present invention to provide a flame detecting apparatus and a flame detecting method which is capable of accurately and surely detecting a flame without causing a mis-operation, even when it receives stationary noise light such as sunlight or light from an incandescent lamp.

In accordance with the present invention, there is provided a flame detecting apparatus and method, in which a flame detector including a directional photodetector such as a photodiode or a phototransistor, which generates a photo-output in response to the intensity of light from a flame, is sequentially driven to scan in a horizontal or a vertical direction by a scanning means, either one of the vertical or horizontal scanning is suspended, while allowing another, horizontal or vertical, scanning to be repeated at the same vertical or horizontal position, by a scanning control means, when the photo-output obtained from the flame detector through the horizontal and vertical scanning exceeds a predetermined threshold value, and it is determined as a real flame by a flame determining means when changes in the photo-outputs obtained through the several scanning exceed a predetermined value.

The present invention is capable of surely preventing a possible mis-operation such that incident stationary noise light such as sunlight or light from an incandescent lamp is falsely detected as a flame and preventing a mis-operation due to single noise light, assuring highly reliable flame detection.

Moreover, the photodiode or the phototransistor used as the photodetector of the flame detector is excellent in the response characteristic as compared with the conventional pyroelectric element, which remarkably improving the horizontal and vertical scanning speed of the light detector for a supervisory region, enabling flame detection by high-speed scanning operation, even if the supervisory region is vast.

DESCRIPTION OF PREFERRED EMBODIMENT

Figure 1:
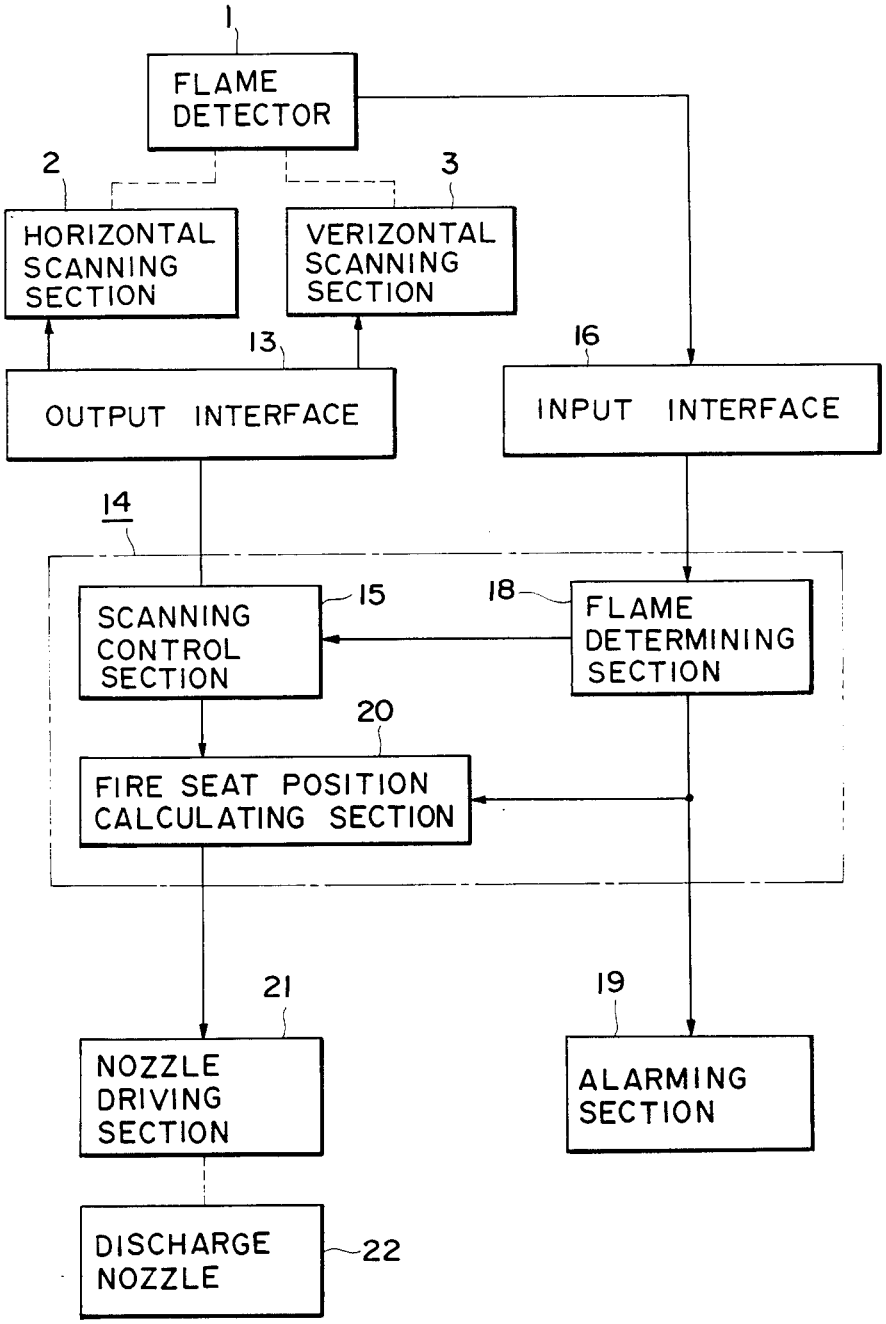
FIG. 1 is a block diagram showing an embodiment of the present invention.

The configuration of a preferred embodiment will now be described, referring to FIGS. 1 to 3. 1 is a flame detector comprising a photodetector such as a photodiode or phototransistor, which generates a photo-output corresponding to the intensity of incident light. The flame detector 1 is mechanically driven, in horizontal and vertical directions, by a horizontal scanning section 2 and a vertical scanning section 3 to scan a supervisory region. A control signal is supplied, from a scanning control section 15 provided in a control unit 14, to the horizontal scanning section 2 and the vertical scanning section 3 for driving the flame detector for horizontal and vertical scanning, respectively, through an output interface 13. On the other hand, a photo-output from the flame detector 1 is input to a flame determining section 18 which is provided in the control unit 14 through an input interface 16. The flame determining section 18 carries out determination operation as to whether a flame is present or not, based on the photo-output obtained through the horizontal and vertical scanning of the flame detector 1.

A determination output, which is generated when the flame determining section 18 determines that a flame is present within the supervisory region, is supplied to an alarming section 19 and a fire seat position computing section 20 provided in the control unit 14. The alarming section 19 gives a fire alarm in response to the determination output.

The fire seat position computing section 20 receives an input from the scanning control section 15, which is indicative of the vertical scanning position of the flame detector 1 and the horizontal scanning position at which the detection output is obtained from the flame detector 1, computes a fire seat position in the supervisory region, based on these positions, and supplies a signal indicative of the computed fire seat position to a nozzle driving section 21 for a discharge nozzle 22 to direct the discharge nozzle 22 to the fire seat position.

Figure 2:
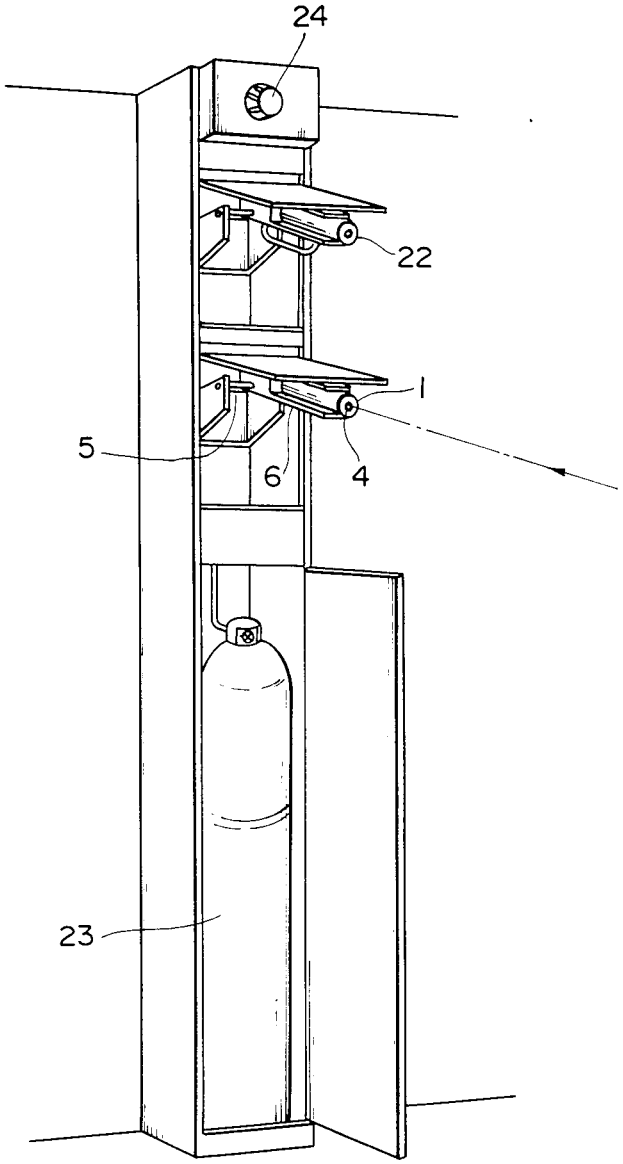
FIG. 2 is an explanatory view of a fire extinguisher robot installed in a flame detecting apparatus.

FIG. 2 is an explanatory view showing one example of a fire extinguishing robot equipped with a flame detector 1 as shown in FIG. 1. The flame detector 1 has a cylindrical casing structure, whose opening 4 provided at a forward end of the casing is directed to the supervisory region so that energy from the supervisory region may be incident upon the flame detector with a directivity. This flame detector 1 is rotated vertically around a horizontal shaft 5 by the vertical scanning section 3 (not shown in FIG. 2) for carrying out the vertical scanning. The detector body 1 is mounted on the support member 6 rotatably in the horizontal direction and turned at a predetermined speed on the surface of the support member 6, for example, by a motor.

The supporting plane of the support member 6 is at any of various angles including horizontal, according to the vertical rotation angle around the horizontal shaft 5 of the detector 1. In this specification and the attached claims, "horizontal scanning" is defined as a scanning effected by the turning of the detector body 1 on the supporting plane of the support member 6, irrespective of the actual angle of the supporting plane. Further a locus of the horizontal search draw an arc in the scanning for a flat floor surface and draw a liner line in the scanning for a vertical wall floor.

In the fire extinguishing robot of FIG. 2, compressed air is supplied, from a pressure bomb 23 provided at a lower portion of the apparatus, to the discharge nozzle 22, to discharge water through the nozzle 22. A smoke detector 24 is provided at an upper portion of the fire extinguishing robot. The flame detector is not driven until the smoke detector 24 detects smoke of a concentration exceeding a predetermined threshold.

The horizontal scanning mechanism and the vertical scanning mechanism will now be described. FIG. 3 illustrates the detail of the flame detector 1 shown in FIG. 2. The flame detector 1 has a cylindrical casing 7 with a transparent window 8 (which may, for example, be an optical filter) provided at a forward end thereof. Light from the supervisory region incident upon the detector 1 through the window 8 is reflected by a condenser mirror 9, which is provided behind, to condense the light to a reflecting mirror 10. The light is further reflected by the reflecting mirror 10 in a downward perpendicular direction so that the light may be incident upon a photodetector 11 which is exposedly provided on the inner surface of the detector casing 7. The casing 7 is fixed to the support member 6 of the fire extinguishing robot through a fixing shaft 12 centrally provided around a position of the photodetector 11. The detector casing 7 is rotated, by the motor (not shown) at a predetermined speed around the fixing shaft 12 on the supporting plane of the support member 6. The horizontal scanning is carried out while the window 8 is being directed to the supervisory region (which is on the forward side of the fire extinguishing robot) during the rotation of the detector casing 7. In the fire extinguishing robot as shown in FIG. 2, the horizontal scanning angle may be about 180°. The rotational angle of the horizontal scanning by the fire detector 1 is detected, for example, by a rotary encoder (not shown).

On the other hand, the vertical scanning mechanism may use a motor which drives the flame detector 1 stepwise in the vertical direction around the horizontal shaft 5. The vertical scanning angle range is preliminarily divided into a plurality of scanning step angles. The scanning step angle may be determined in various manners. For example, first, a reference scanning step angle is selected so that it may correspond to a predetermined reference flame size and other scanning step angles are determined so that they may be reduced as the detecting object points become more distant. In this case, horizontal scanning is carried out at every scanning step angle. The flame detector 1 is rotated stepwise sequentially in the vertical direction, while carrying out horizontal scanning at every step.

Figure 3:
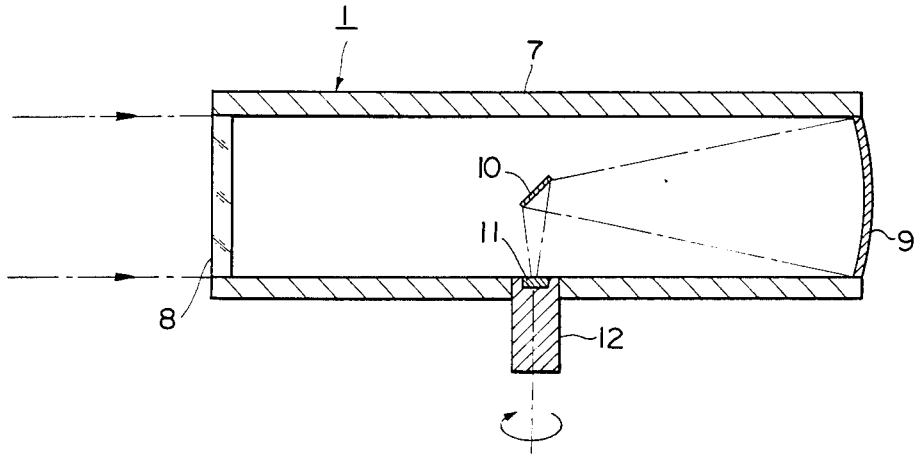
FIG. 3 is an explanatory view of the configuration of the flame detector provided in the apparatus of FIG. 2.
Figure 7:
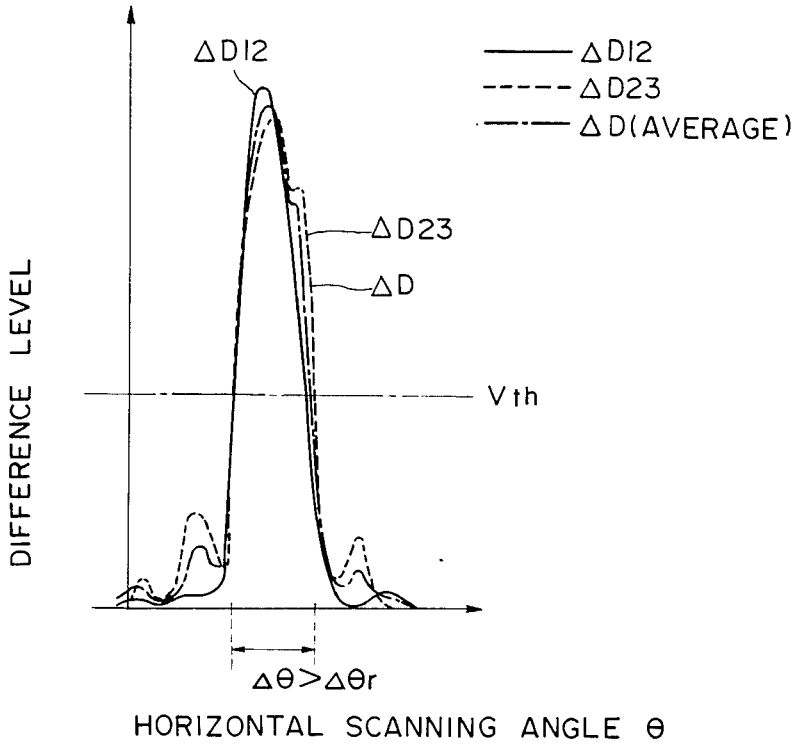
FIG. 7 is a graph showing differences between the photo-outputs of FIG. 6.

The configuration of the flame detector 1 is not limited to that as shown in FIGS. 2 and 3 and may be of any form so long as it can receive, with directivity, light energy from the supervisory region incident upon the photodetector. Similarly, the horizontal and the vertical scanning mechanism are not limited to those as illustrated and, for example, separate motors may alternatively be employed for driving the flame detector 1 in the horizontal direction and in the vertical direction, respectively.

The determination operation at the flame determining section 18 will now be described.

The flame determining section 18 carries out the following determination operation on the basis of the photo-outputs obtained through the horizontal and vertical scanning of the flame detector:

(a) The photo-outputs from the flame detector 1 are compared with a predetermined threshold value and an output is generated to the scanning control section 15 when the outputs exceed the threshold value to let the vertical scanning section 3 stop the vertical scanning and allow the horizontal scanning section 2 to repeat horizontal scanning N (for example N is 3) times.

(b) Calculation is made to obtain differences $\Delta D12$, $\Delta D23$, . . . $\Delta Dn-1n$ between the photo-outputs D1, D2, . . . Dn from the flame detector 1 obtained through N-time horizontal scanning.

(c) It is determined as flame when a state in which these differences $\Delta D12$, $\Delta D23$, . . . $\Delta Dn-1n$ exceed the predetermined threshold value lasts over a predetermined scanning angle range.

Figure 5:
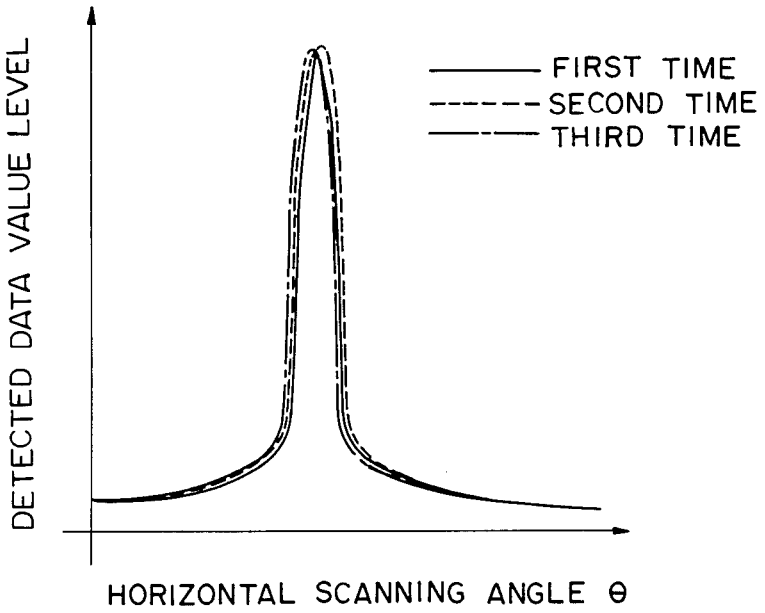
FIG. 5 is a graph showing photo-outputs obtained by three horizontal scanning operations, in response to incident stationary noise light, such as light from an incandescent lamp.
Figure 6:
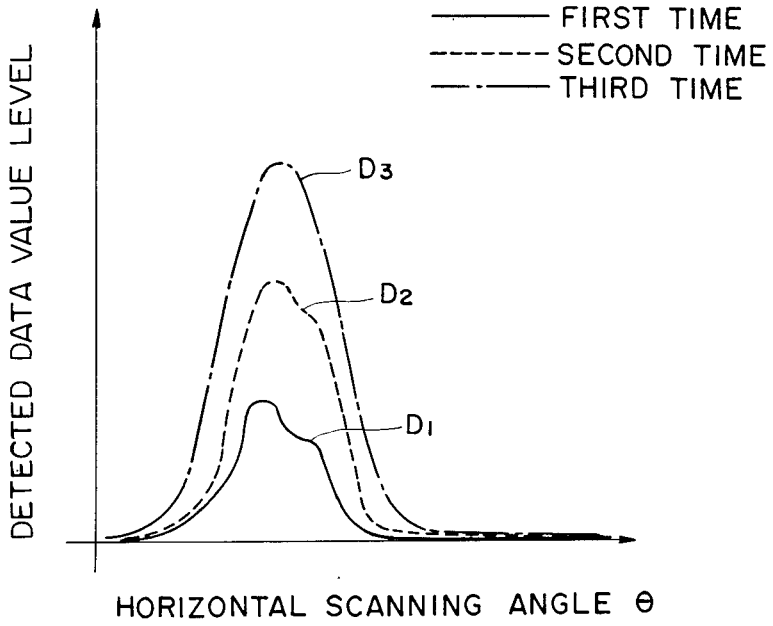
FIG. 6 is a graph showing changes in photo-outputs obtained by three horizontal scanning operations, in response to incident light from a flame.

This determination operation is based on the experimentally obtained photo-output data as shown in FIGS. 5 and 6.

FIG. 5 is a graph showing detection outputs from the flame detector 1 with respect to a horizontal scanning angle $\theta$ when a light source such as an incandescent lamp is placed on a position within the supervisory region. The intensity of the light from the stationary light source such as the incandescent lamp is substantially constant. Therefore, the changes in the photo-outputs obtained by the three horizontal scanning, respectively, are substantially the same and the variations between the respective scanning is little.

In contrast, photo-outputs D obtained when a flame exists within the supervisory region differ largely between respective horizontal scanning operations as shown in FIG. 6. The suffixes 1 to 3 as of D1, D2 and D3 indicate the photo-outputs in the first scanning, second scanning and third scanning, respectively. Such variations are due to flickering phenomenon inherent in a flame (the flickering of the flame is known to have a frequency of 0.5 to 20 Hz). If the difference between the detection outputs D1 and D2 obtained by said three horizontal scanning operations are assumed as $\Delta D12$ and the difference between the detection outputs D2 and D3 is assumed as $\Delta D23$, a horizontal scanning angle $\Delta\theta$, where an average $\Delta\overline{D}$ of the two differences exceeds a predetermined threshold value Vth, last over a predetermined scanning angle range $\Delta\theta r$ in the case of the flame. This ensures the flame determination.

On the other hand, if flash light for photographing happens to be detected, the detection outputs in the second and third horizontal scanning operations are much lowered than the detection output D1 in the first scanning operation. In this case, therefore, the difference $\Delta D12$ is large and the difference $\Delta D23$ is substantially zero and the average $\Delta\overline{D}$ does hardly exceed the threshold value Vth. Even if the average $\Delta\overline{D}$ exceeds the threshold value Vth, there is little possibility that the state exceeding the threshold value lasts over the predetermined angle of $\Delta\theta r$. Thus, there is substantially no possibility that fire determination is made errorneously.

The functions of the flame determining section 18, the scanning control section 15 and the fire seat position computing section 20 may be implemented by a combination of a microcomputer and an appropriate program and appropriate terminal equipments.

The flame determination operation will now be described referring to a flowchart of FIG. 4. The flowchart of FIG. 4 further refers to the control of the discharge nozzle based on the fire determination.

When the apparatus is first actuated, the flame detector 1 is set in a vertical initial position (block 30). The vertical initial position of the flame detector 1 is preferably a position where the flame detector 1 is directed to its downward extremity or to its upward extremity, or directed horizontally. After completion of the setting of the flame detector 1 to the vertical initial position at block 30, the processing proceeds to block 31 to start the horizontal scanning of the flame detector 1.

At next determining block 32, it is checked whether one horizontal scanning has been completed or not on the basis of the horizontal scanning angle. After the flame detector 1 has completed one full rotation on the support member 6, the processing proceeds to a further determining block 33 to compare the detection value D from the flame detector 1 obtained by said one horizontal scanning with the predetermined threshold value.

The comparison of the detection output obtained by one horizontal scanning of the flame detector 1 with the threshold value may be made after the detection values obtained by one horizontal scanning is stored in a memory. Alternatively, the detection output may be directly compared, at a real time, with the threshold.

When the detection output from the flame detector 1 obtained by one horizontal scanning is lower than the threshold value in the comparison at block 33, the processing proceeds to block 34 to move the flame detector 1 by one step of the predetermined vertical scanning step angle. Then, the processing returns to block 31 to carry out further horizontal scanning.

On the other hand, if the detection output exceeding the threshold value is obtained from the flame detector 1 at determining block 33, the processing proceeds to block 35 to give an increment to a counter N. At determining block 36, it is checked whether the counter N reaches 3 or not. If it does not reach 3, then the processing is moved to block 35*a* to carry out horizontal scanning at the same vertical scanning position again. After completion of three horizontal scanning, the processing proceeds from determining block 36 to block 37 to obtain level differences $\Delta D12 = D1 - D2$ and $\Delta D23 = D2 - D3$ and further calculate an average $\Delta\overline{D}$ of these level differences $\Delta D12$ and $\Delta D23$.

Then, the processing proceeds to determining block 38 to compare the average $\Delta\overline{D}$ of the level differences through the three horizontal scanning obtained at block 37 with the predetermined threshold value Vth. When the average $\Delta\overline{D}$ is lower than the threshold value Vth, it is determined as noise light such as sunlight or light from an incandescent lamp and the processing returns to block 34 without generating a flame determination output to carry out step movement to a next vertical scanning position. On the other hand, if a state where the average $\Delta\overline{D}$ of the level differences exceeds the threshold value lasts over a predetermined horizontal scanning angle range $\Delta\theta r$, the processing proceeds to a determining block 39 where it is determined that the whole area of the supervisory region has been scanned, and if it is determined that the whole scanning has not been completed, then the processing returns to the block 34 to carry out the stepwise movement to a next vertical position. While if it is determined that the whole scanning has been completed, then the processing goes to a block 40. In the block 40, the largest flame is selected from the detemined flames in the whole supervisory region. The largest flam is to be extinguished, and in a block 41 the calculation of the fire seat is carried out as well as give a fire alarm.

Figure 4A:
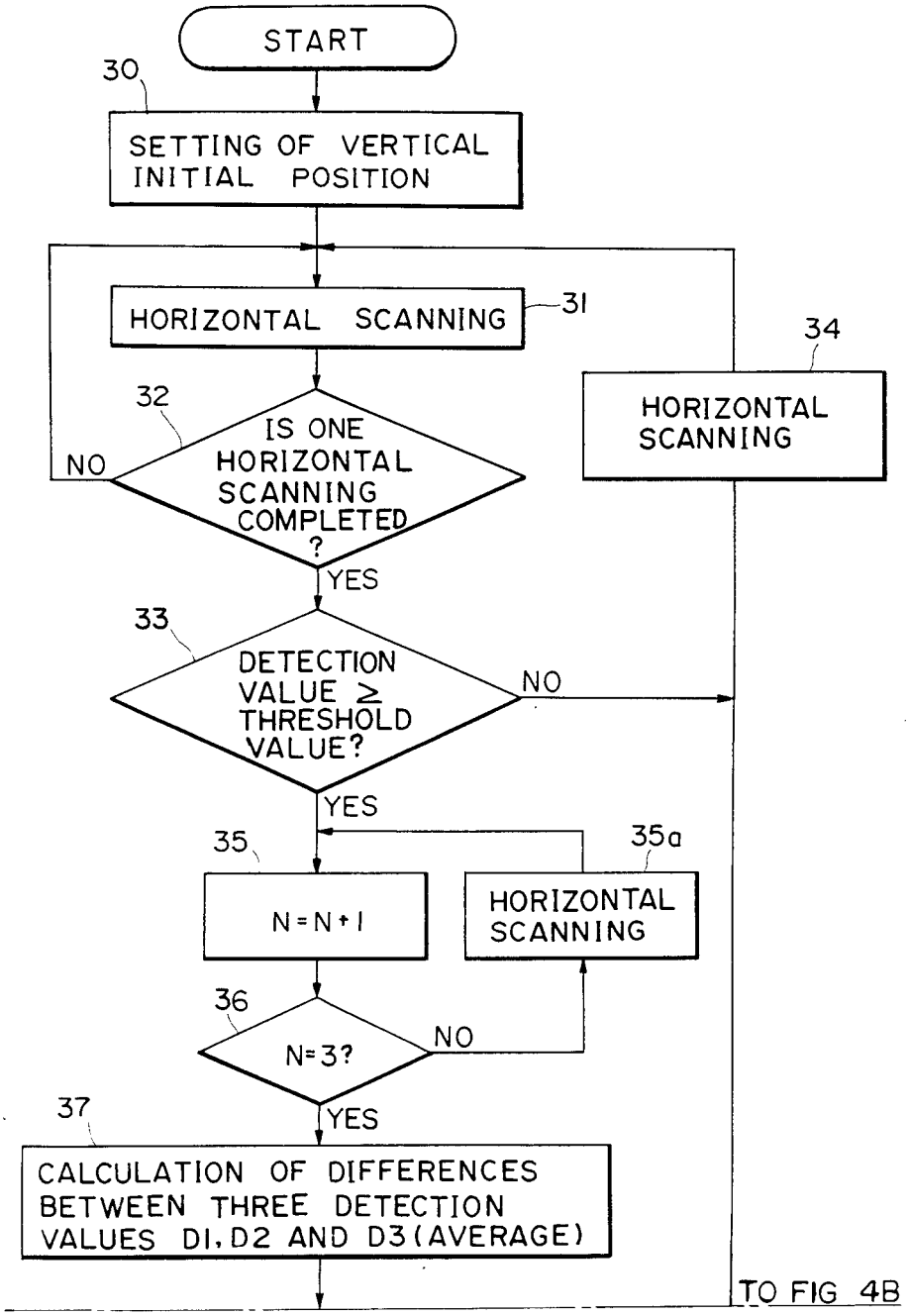
FIGS. 4A and 4B are flowcharts showing a flame determination operation in accordance with the embodiment of FIG. 1.
Figure 4B:
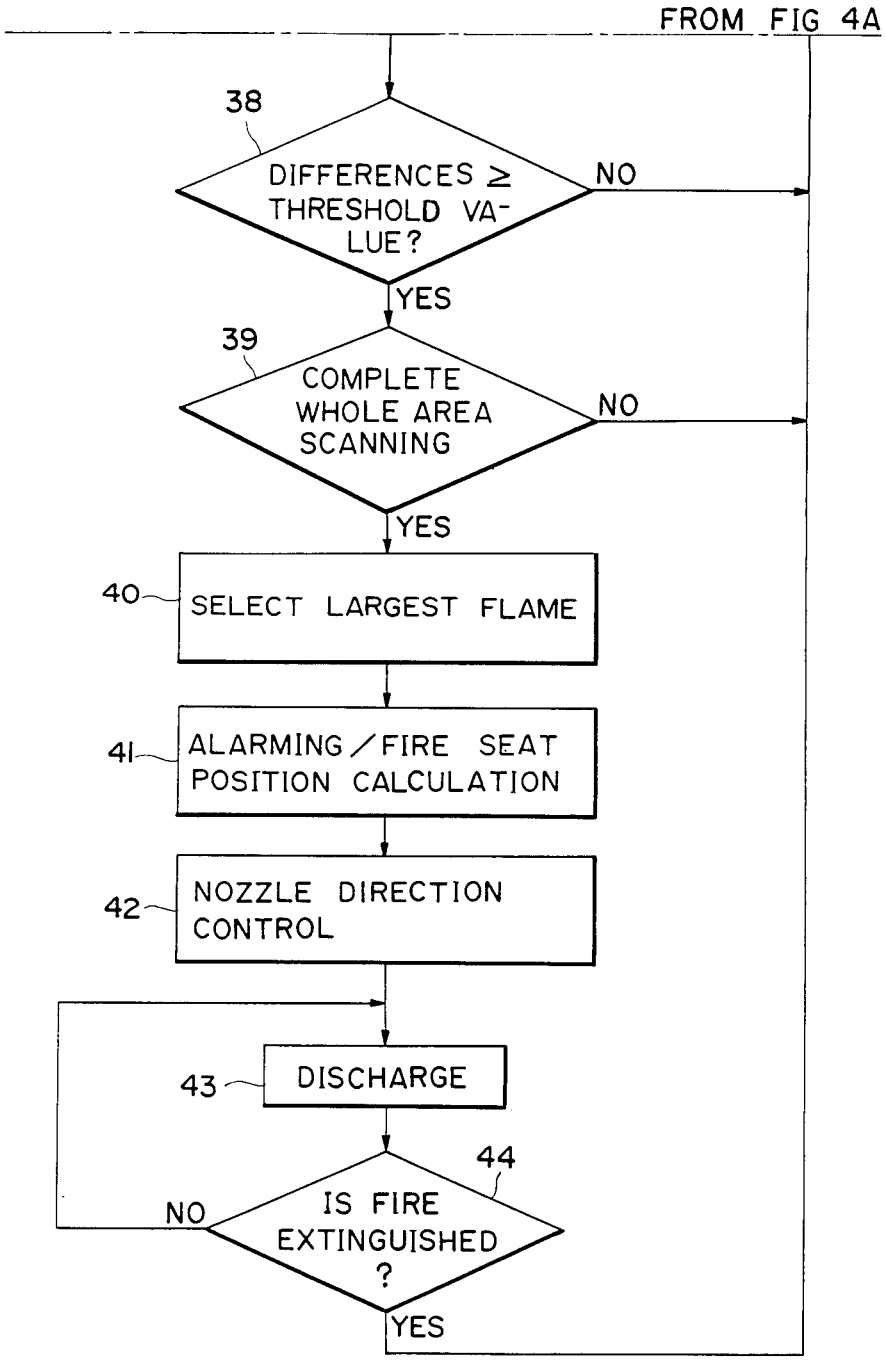

Although the average $\Delta\overline{D}$ of the differences $\Delta D12$ and $\Delta D23$ of the three detection values is calculated at block 37 so as to be compared with the threshold value at determining block 38 in the flowchart as shown in FIG. 4, it is not always essential to calculate the average value. With this respect, a fire determination may be made when at least one of the differences between the respective detection outputs D1 to D3 exceeds the threshold value and the state exceeding the threshold value lasts over the predetermined scanning angle. When the fire seat position is calculated on the basis of the fire determination output at block 41, the direction of the discharge nozzle 22 is controlled at block 42 and water is discharged from the nozzle 22 to the flame at block 43. The fire extinguishing conditions as a result of the discharge of water is monitored at determining block 44. After fire extinguishment has been confirmed, the processing returns to block 34 to carry out the stepwise movement to a next vertical position. Of course, the vertical and horizontal scanning of the flame detector may alternatively be continued during the water discharge at block 43.

Although only the horizontal scanning is repeated a couple of times, while suspending the vertical scanning, when a detection output exceeding the predetermined threshold value is obtained from the flame detector in the embodiment as illustrated, the vertical scanning may alternatively be carried out several times over a preset vertical scanning range while suspending the horizontal scanning.

The scanning frequency N of vertical or horizontal scanning after the detection output exceeding the threshold value has been obtained from the flame detector is not limited to 3 and may be selected freely. The larger the scanning frequency, the more accurate the flame detection. Furthermore, even after the first flame detection, the horizontal and the vertical detection may be continued. In this case, the flame detector is returned to the flame detected position after monitoring of the entire region to repeat the flame detecting scanning.

We claim:

1. A flame detecting apparatus comprising:

a flame detector having a directivity and comprising a photodetector generating a photo-output in response to the intensity of incident light;

scanning means for driving said flame detector to sequentially scan in a horizontal and a vertical direction within a supervisory region;

scanning control means suspending one of the horizontal and the vertical scanning while repeating the other, a horizontal or vertical position being scanned continuously a plurality of times when a photo-output from said flame detector obtained in the horizontal or vertical scanning by said scanning means exceeds a predetermined threshold value; and flame determining means comparing the photo-outputs obtained through the repeated scanning to each other and calculates the changes in the photo-output, said flame determining means determining that there is really a flame when changes in the photo-outputs obtained through repeated scanning exceed a predetermined value.

2. A flame detecting apparatus claimed in claim 1, in which the flame determining means determines there is really a flame when the changes in the photo-outputs obtained through the repeated scanning exceed a predetermined value and they last over a predetermined scanning angle.

3. A flame detecting apparatus claimed in claim 2, which further comprises a fire seat position calculating means which calculates a position of a fire seat based on the horizontal and vertical scanning angles, at which the detection output indicative of the presence of a real flame determined by said flame determining means.

4. A flame detecting apparatus claimed in claim 3, wherein said flame detector comprises a cylindrical casing for accomodating said photodetector and adapted to impart said directivity to said flame detector.

5. A flame detecting apparatus claimed in claim 4, wherein said scanning means includes a horizontal scanning means and a vertical scanning means, said horizontal scanning means rotating said cylindrical casing in the horizontal direction and said vertical scanning means rotating said cylindrical casing stepwise in the vertical direction.

6. A flame detecting method comprising the steps:

providing a flame detector having a directivity and a photodetector for producing a photo-output in response to the intensity of light incident therupon;

scanning said flame detector sequentially in horizontal and vertical directions within a supervisory region;

suspending one of the horizontal and vertical scanning while repeating the other vertical or horizontal; scanning the same horizontal or vertical position several times when a photo-output from said flame detector obtained in the horizontal or vertical scanning by said scanning means exceeds a predetermined threshold value; and comparing the photo-outputs obtained through repeated scanning to each other and calculating the changes in the photo-outputs; and determining that there is really a flame when changes in the photo-outputs obtained through repeated scanning exceed a predetermined value.

7. A flame detecting method as claimed in claim 6, in which it is determined that there is really a flame when the changes in the photo-outputs, which is obtained through the repeated scanning, exceed a predetermined value and they last over a predetermined scanning angle.

8. A flame detecting method as claimed in claim 6, which further comprises calculation of a position of a fire seat based on the horizontal and vertical scanning angle, at which the detection output indicative of the determined real presence of the flame.

* * * * *